US005736971A

United States Patent [19]

Shirai

[11] Patent Number: 5,736,971

[45] Date of Patent: Apr. 7, 1998

[54] METHOD AND APPARATUS FOR INCREASING RESOLUTION OF A COMPUTER GRAPHICS DISPLAY

[75] Inventor: Satoru Shirai, Nagoya, Japan

[73] Assignee: Melco Inc., Nagoya, Japan

[21] Appl. No.: 360,826

[22] PCT Filed: Apr. 4, 1994

[86] PCT No.: PCT/JP94/00707

§ 371 Date: Dec. 22, 1994

§ 102(e) Date: Dec. 22, 1994

[87] PCT Pub. No.: WO94/25953

PCT Pub. Date: Nov. 10, 1994

[30] Foreign Application Priority Data

Apr. 27, 1993 [JP] Japan ..... 5-125440

[51] Int. Cl.[6] ..... E09G 1/16

[52] U.S. Cl. ..... 345/127; 345/132; 345/213; 348/448; 348/555; 348/556

[58] Field of Search ..... 345/127, 132; 348/448, 555, 556, 911, 552

[56] References Cited

U.S. PATENT DOCUMENTS

| | | | |
|---|---|---|---|
| 4,574,279 | 3/1986 | Roberts | 340/731 |
| 4,660,070 | 4/1987 | Nishi et al. | 358/11 |
| 4,905,167 | 2/1990 | Yamaoka et al. | 364/521 |
| 5,153,712 | 10/1992 | Masaike | 358/22 |
| 5,341,172 | 8/1994 | Nio et al. | 348/441 |
| 5,351,088 | 9/1994 | Nio et al. | 348/441 |
| 5,448,260 | 9/1995 | Zenda et al. | 345/100 |
| 5,475,442 | 12/1995 | Matsushita et al. | 348/554 |
| 5,544,315 | 8/1996 | Lehfeldt et al. | 395/200.2 |

*Primary Examiner*—Mark R. Powell
*Assistant Examiner*—Vincent E. Kovalick
*Attorney, Agent, or Firm*—Hickman Beyer & Weaver

[57] ABSTRACT

The graphic board can be mounted inside the expansion slot of the computer, and the frequencies of the horizontal synchronizing signal and the vertical synchronizing signal can be preset finely through presetting the values on the registers from the computer side.

At the start of display, the display is carried out in synchronizing frequencies corresponding to the original 640 dots by 400 lines display of the CRT display device (step S100) Then, the synchronizing frequencies are increased gradually to the target values corresponding to the 640 dots by 480 lines display (steps S120 through S140). During this time, the CRT display device will continue synchronization against fluctuation of the frequency within an allowable range with the operation of an internal synchronization circuit. Consequently, the CRT display device can maintain synchronization all through to the target values, and thus a 640 dots by 480 lines display is available.

9 Claims, 5 Drawing Sheets

| Parameter/Bit | 9 | 8 | 7 | 6 | 5 | 4:0 |
|---|---|---|---|---|---|---|
| H Total | | | CR0[7] | CR0[6] | CR0[5] | CR0[4:0] |
| H Display End | | | CR1[7] | CR1[6] | CR1[5] | CR1[4:0] |
| H Blank Start | | | CR2[7] | CR2[6] | CR2[5] | CR2[4:0] |
| H Blank End | | | CR1A[5] | CR1A[4] | CR5[7] | CR3[4:0] |
| H Sync Start | | | CR4[7] | CR4[6] | CR4[5] | CR4[4:0] |
| H Sync End | | | | | | CR5[4:0] |
| V Total | CR7[5] | CR7[0] | CR6[7] | CR6[6] | CR6[5] | CR5[4:0] |
| V Sync Start | CR7[7] | CR7[2] | CR10[7] | CR10[6] | CR10[5] | CR10[4:0] |
| V Sync End | | | | | | CR11[3:0] |
| V Display End | CR7[6] | CR7[1] | CR12[7] | CR12[6] | CR12[5] | CR12[4:0] |
| V Blank Start | CR9[5] | CR7[3] | CR15[7] | CR15[6] | CR15[5] | CR15[4:0] |
| V Blank End | CR1A[7] | CR1A[6] | CR16[7] | CR16[5] | CR16[5] | CR16[4:0] |
| Line Compara | CR9[6] | CR7[4] | CR18[7] | CR18[6] | CR18[5] | CR18[4:0] |
| Offset | | CR1B[4] | CR13[7] | CR13[6] | CR13[5] | CR13[4:0] |

METHOD AND APPARATUS FOR INCREASING RESOLUTION OF A COMPUTER GRAPHICS DISPLAY

[TECHNICAL FIELD]

The present invention relates to a device for the display of graphic images of a predetermined number of dots and lines on connected CRT display devices.

[BACKGROUND ART]

A graphic display device for the display of images on a CRT display device is generally equipped with a video controller (CRTC) where the resolution (the number of dots by the number of lines) of a displayed image can be freely set to some extent. The video controller is equipped with registers for setting the parameters, such as for the frequencies of a horizontal synchronizing signal and a vertical synchronizing signal which are contained in the video signal. The video controller is connected to a bus of a computer or such device and the computer can set the values of these registers. The values corresponding to the number of dots and lines available for the connected CRT display device are set for these registers in the video controller as default values or by a CPu. The video controller generates the video signal which contains the horizontal synchronizing signal and the vertical synchronizing signal corresponding to the number of dots and lines that are available for the CRT display device based on the values set for the register; thus the desired image is displayed on the CRT display device.

Along with the spread of such device as graphical user interfaces (GUI) in recent years, there is an increasing demand for a display offering a larger number of dots and lines of not less than 640 dots by 480 lines. Therefore, a graphic display device which is to be mounted inside an expansion slot for an increase in the number of dots and lines of a conventional device has been proposed.

However, for users of such a graphic display device, there has remained a problem that the number of dots and lines of the actually displayed image cannot be increased by the addition of the graphical display device unless the number of dots and lines available for the CRT display device correspond to them. Although a CRT display device, named as a multisynchronization type or such, where the number of dots and lines to be displayed are variable has been proposed, the number of dots and lines to be displayed on an ordinary CRT display device are fixed at certain values (ex. 640 dots by 400 lines); therefore, if the graphic display device outputs a signal corresponding to a display of 640 dots by 480 lines, the graphic image cannot be accurately displayed.

Further consideration is given to this problem. So long as the number of images (number of frames) to be displayed in a certain period of time is fixed, an increase in the number of displayed dots (the number of lines in the vertical direction) requires higher horizontal synchronizing frequency (lower vertical synchronizing frequency). Since a clock is not commonly used on the side where a video signal is output and on the CRT display device side, their signals never coincide. Therefore, the CRT display device synchronizes the horizontal images so that such images will be located properly in the horizontal direction on the screen by the video signal inserted between the horizontal synchronizing signals, utilizing the horizontal synchronizing signal as a reference. The vertical images are similarly synchronized with the use of the vertical synchronizing signals. Therefore, an accurate display is available when the deviation of the frequencies of the horizontal and the vertical synchronizing signals occurs; but screen images become synchronous due to failure in the image synchronization if a video signal of a frequency out of the correspondable allowance range is input.

The graphic display device and Computer by the present invention are purposed to solve these problems and to enable the display of images in the number of dots and lines larger than those originally available to the CRT display device.

[DISCLOSURE OF INVENTION]

To solve the above-described problems, the graphic display devices by the present invention: which consist of such a graphic display device to output a video signal containing a horizontal synchronizing signal and a vertical synchronizing signal to display an image on an external CRT display device where the number of dots and lines is larger than the number of original dots and lines of said CRT display device, which comprises; an initial frequency presetting means for presetting a frequency of one of said horizontal synchronizing signal and said vertical synchronizing signal so as to be a initial value which corresponds to the number of dots and lines where said CRT display device can synchronize in a initial stage of display, and a preset frequency modification means for modifying gradually said frequency preset by said initial frequency presetting means into a value corresponding to the number of dots and lines larger than said the number of original dots and lines of said CRT display device.

The above-described graphic display device may have registers for presetting said horizontal synchronizing signal and said vertical synchronizing signal, and said initial frequency presetting means and said preset frequency modification means involve a means for presetting values of said registers. The above-described graphic display device may have a structure which includes a switching means for switching between first video signal which has been input from an external device and corresponds to said the number of original dots and lines of said CRT display device and second video signal which has been adjusted to said value corresponding to the number of dots and lines larger than said the number of original dots and lines of said CRT display device by said initial frequency presetting means and said preset frequency modification means so as to be output to said CRT display device. The above-described graphic display device may have another structure which comprises two connectors with different pin arrays to output of said video signal adjusted by said initial frequency presetting means and said preset frequency modification means to said CRT display device. The above-described graphic display device may have still yet another structure, with the use of an expansion slot of a computer, where said preset frequency modification means involves a structure where said computer gradually changes target values of said horizontal synchronizing signal and said vertical synchronizing signal.

On the graphic display device with such constructions, the initial frequency presetting means synchronizes first in the horizontal direction or the vertical direction of the CRT display device with the frequency of the horizontal or the vertical synchronizing signal of the video signal to be output to the CRT display device as the initial value corresponding to the number of dots and lines which the CRT display device can synchronize with at the time of the initial stage of display. If the initial frequency presetting means presets the value which is synchronizable in both the horizontal and the vertical directions, the resulting images will be displayed accurately on the CRT display device. However, since it is not always possible to synchronize both the horizontal and the vertical directions in the initial stage, image asynchronization may occur.

Then, the preset frequency modification means of the graphic display device will gradually increase the frequency of either the horizontal synchronizing signal and the vertical synchronizing signal and it will take time to modify the value so as to correspond to the number of dots and lines larger than the number of original dots and lines of the CRT display device. At this time on the CRT display device side, an internal synchronization circuit operates continuously to prevent any deviations of the frequency within the allowance. That is, the CRT display device cannot synchronize at all if a video signal for a frequency much different from the normal value is output from the beginning, but it can display images in the number of dots and lines which are different from the original ones if modifications to the frequency is made after synchronization with a normal value, in either direction, has once been carries out.

Therefore, utilization of the graphic display device by the present invention is highly advantageous in that trials in the higher resolution environment can be made without any change in the hardware related to the CRT display device.

The computer by the present invention is equipped with the above-described graphic display device mounted on an expansion slot accessible from a processor. It is possible with a computer with an expansion slot where the above-described graphic display device can be mounted to display an image of which the number of dots and lines is modified.

The graphic display method by the present invention is a graphic display method where a video signal containing a horizontal synchronizing signal and a vertical synchronizing signal is output to display a image on an external CRT display device on which the number of dots and lines is larger than the number of original dots and lines of said CRT display device, said graphic display method further comprising the steps of: a frequency of one of said horizontal synchronizing signal and said vertical synchronizing signal being preset so as to create a initial value which corresponds to the number of dots and lines to which said CRT display device can synchronize in a initial stage of display; after synchronization to the number of dots and lines corresponding to said initial value, said frequency of one of said horizontal synchronizing signal and said vertical synchronizing signal being gradually modified to a value corresponding to the number of dots and lines larger than said the number of the original dots and lines of said CRT display device; and an image in the number of dots and lines larger than said the number of original dots and lines of said CRT display device is displayed on said CRT display device.

In the above-described graphic display method, it may have another structure where a gradual modification of a target value is available as a function of a device driver which is included in a operating system of a computer and is carried out as part of a initial processing operation of said device driver at the time of starting up said operating system.

The graphic display method with such structures synchronizes first in the horizontal direction or the vertical direction of the CRT display device with the frequency of the horizontal synchronizing signal or the vertical synchronizing signal of the video signal to be output to the CRT display device as the initial value corresponding to the number of dots and lines which the CRT display device can synchronize with at the time of the initial stage of display. Then, the frequency of either the horizontal synchronizing signal and dots and lines the vertical synchronizing signal is gradually increased and it takes time to modify the value so as to correspond to the number of dots and lines larger than the number of original dots and lines of the CRT display device. On the CRT display device side, an internal synchronization circuit operates continuously to prevent any deviations of the frequency within the allowance. The CRT display device cannot synchronize at all if a video signal for a frequency much different from the normal value is output from the beginning, but it can display images in the number of dots and lines which are different from the original ones if modifications to the frequency is made after synchronization with a normal value, in either direction, has once been carried out.

Therefore, utilization of the graphic display method by the present invention is highly advantageous in that trials in the number of original dots and lines of the CRT display device with a larger image or a higher resolution environment can be made without any changes in the hardware related to the CRT display device.

[BEST MODE FOR CARRYING OUT THE INVENTION]

Figure 1:
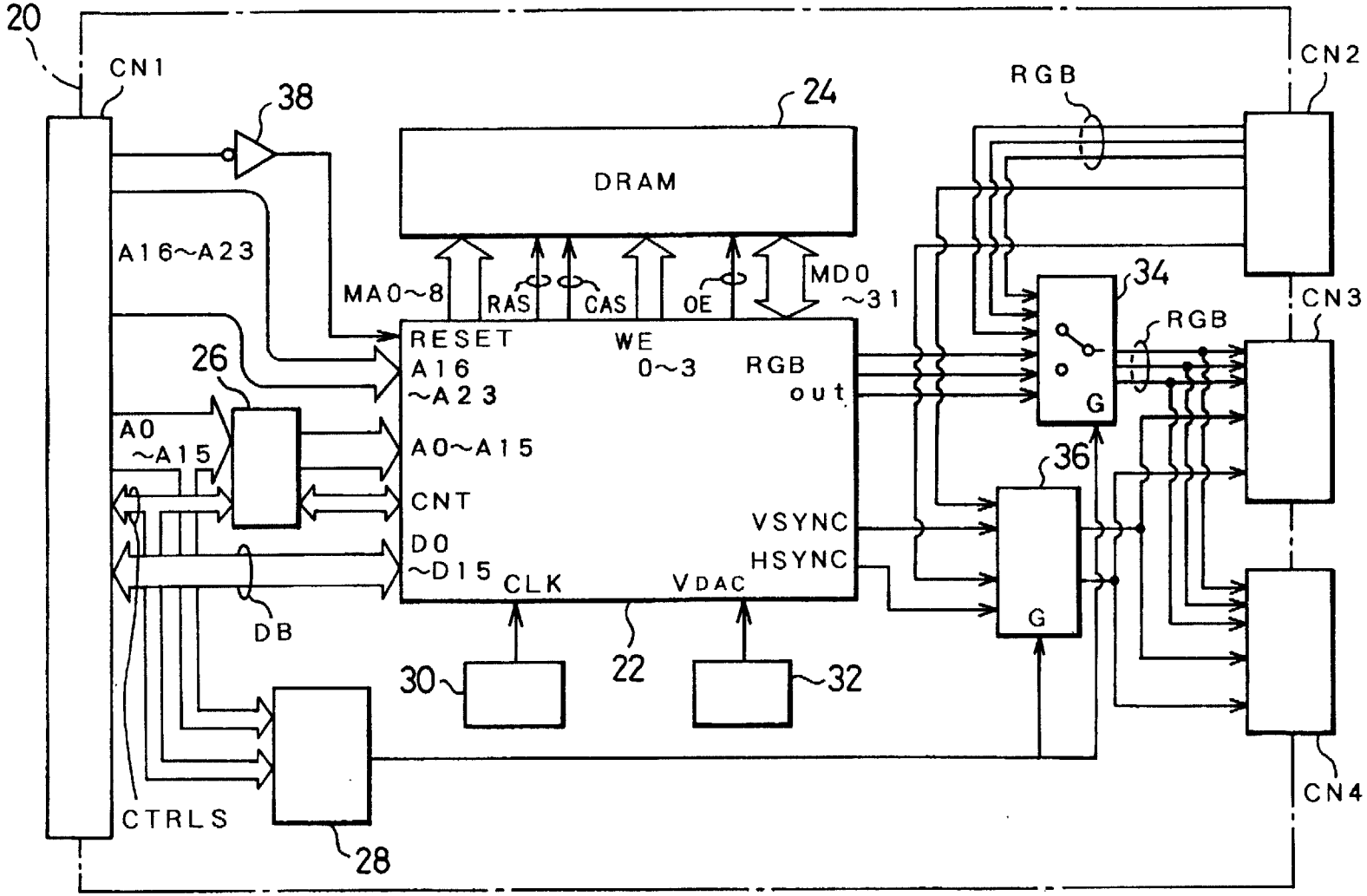
FIG. 1 is an outlined configuration of the graphic board 20 which is an embodiment of the present invention.

The following paragraphs describe a preferred embodiment of the present invention. FIG. 1 is a block diagram showing the outlined configuration of a graphic board 20 as an embodiment.

The graphic board 20 is mounted inside the expansion slot of a computer and is electrically connected to the bus of the computer by a connector CN1. The expansion slot is connected to an address bus ADB, a data bus DB, a control signal bus CTRLS and so on to enable direct access from the internal CPU in the computer. The graphic board 20 operates with the signals and power supplied by the computer.

The graphic board 20 is equipped with a CRTC 22 which has more sophisticated functions than the CRTC in the main body of the computer, a high-speed DRAM24 for image data development, a bus converter circuit 26 for bus interfacing with the computer, an address decoder 28 for video signal switching, a generator 30 for generation of the reference clock CLK of the CRTC 22, a constant current circuit 32 for the supply of a reference current for the analog RGB to the CRTC 22, a three-circuit microrelay 34 for RGB signal switching, a double-three-circuit data selector 36 for switching video signals, the horizontal synchronizing signal and the vertical synchronizing signal, an invertor 38 for inverting reset signals from the computer so as to match the logic of the CRTC 22, and so on. The microrelay 34 switches between the output of the analog RGB signals which are input from an external device via a connector CN2 (normally, signals from the main body of the computer) and the output of the analog RGB signals from the CRTC 22.

Figure 2:
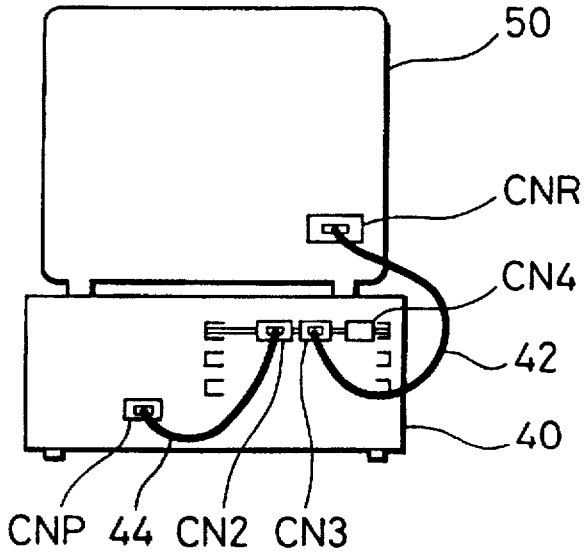
FIG. 2 is an illustrative drawing showing the state of the connection between the computer 40 on which the graphic board 20 is mounted and the CRT display device 50.

In the following paragraphs, the analog RGB signals, the horizontal synchronizing signal HSYNC and the vertical synchronizing signal VSYNC are comprehensively referred to as video signals. For the output of video signals, the graphic board 20 in the embodiment is equipped with two connectors for outputs CN3 and CN4 which have different pin arrays. The connections of these connectors are briefly described hereafter. As FIG. 2 shows, the graphic board 20 is mounted inside the expansion slot built into the back of the computer. The connectors CN2, CN3 and CN4 for the graphic board 20 protrude from the back of the computer 40. The output connector CNP for the analog RGB, which is built into the computer 40, is connected to the input connector CNR for the CRT display device 50 before the graphic board 20 is mounted.

If such a graphic board 20 is to be mounted, disconnect the connection cable 42 from the output connector CNP and connect it to the connector CN3 of the graphic board 20. Besides this, another cable 44 connects the connector CNP of the computer 40 to the connector CN2 of the graphic board 20. Consequently, when the microrelay 34 and a data selector circuit 36 are driven, the conventional video signals output from the computer 40 and the video signals output from the graphic board 20 can be output selectively to the CRT display device 50. The switching of the microrelay 34 and the data selector circuit 36 is carried out when a predetermined I/O address assigned to the graphic board 20 is accessed. When this I/O address is accessed, the output from the address decoder 28 turns active and the signal output from the address decoder 28 drives the microrelay 34 and the data selector circuit 36. Therefore, if the computer 40 side is provided with a program for accessing this I/O address, the display can be easily switched.

The internal connections of the graphic board 20 are briefly described hereafter. The eight higher-order bits of the address bus on the computer side (A0 through A23, a total of 24 bits) are respectively connected to the input addresses A16 through 23. The sixteen lower-order bits are connected to the bus converter circuit 26 where the I/O addresses from the computer side are converted. The sixteen lower-order bits are not directly connected to the CRTC 22 because the I/O addresses used by the CRTC 22 (completely defined) are overlapped with the addresses already defined on the computer side.

The sixteen lower-order bits and the control signal CTRLS are connected not only to the bus converter 26 but also to the address decoder 28. The address decoder 28 is a circuit where signals for driving the above-described microrelay 34 and the data selector circuit 36 are generated. The address decoder 28 switches the outputs when predetermined data from the computer 40 is accesses horizontal retrace on a predetermined address.

The DRAM 24 consists of two 4 MB chips of 256 K by 16 bits and is connected to the CRTC 22 by the address busses MA0 through MA8, signals RAS and CAS, 4-bit write/enable signals WE0 through WE3, an output enable signal OE, and 32-bit data busses MD0 through MD31.

As described above, the analog RGB signal, the horizontal synchronizing signal HSYNC and the vertical synchronizing signal VSYNC, which are output from the CRTC 22, are connected to the connectors CN3 and CN4 via the microrelay 34 and the data selector circuit 36.

Figure 3:
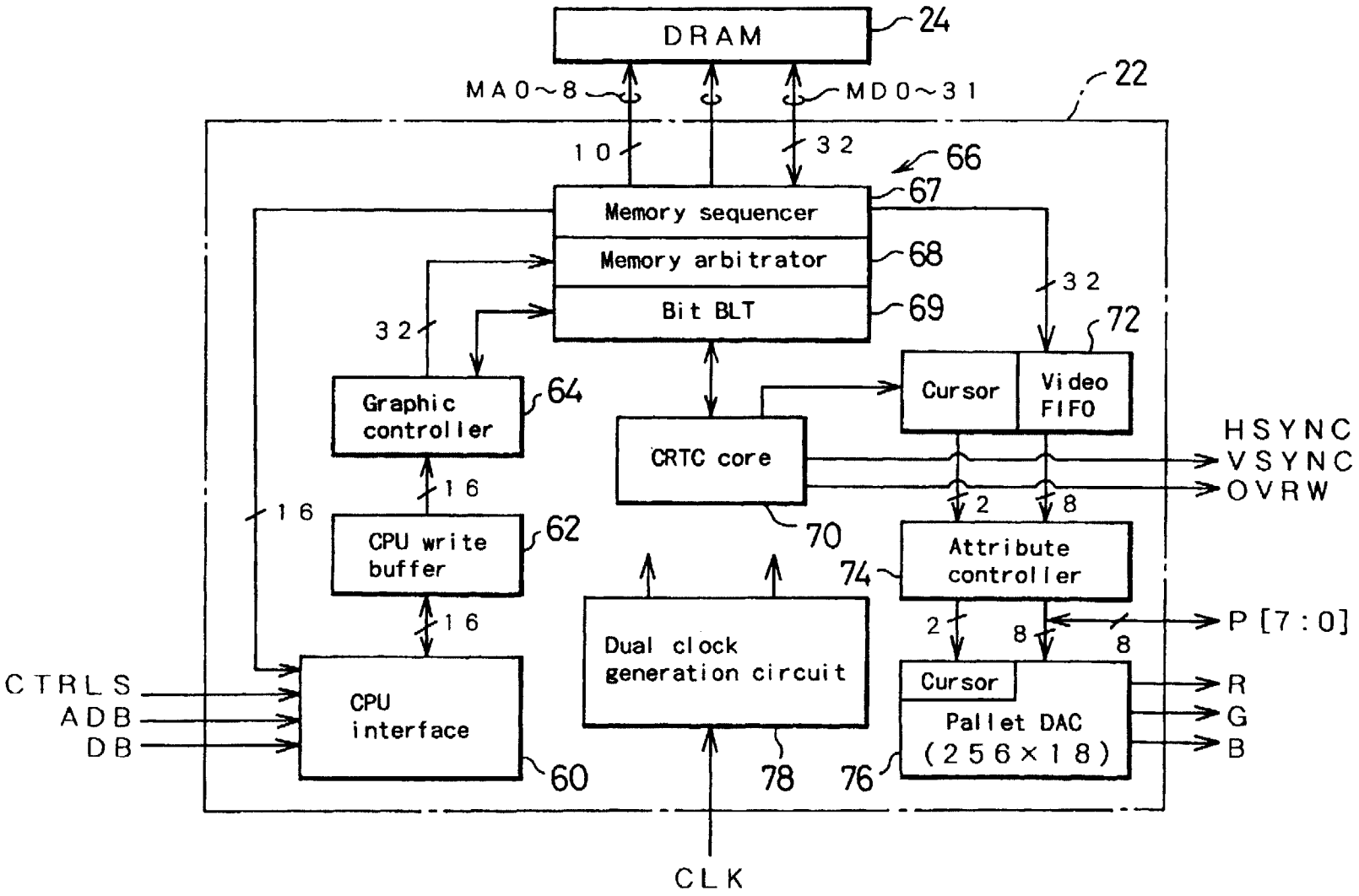
FIG. 3 is a block diagram showing an example of the internal configuration of the CRTC 22.

A VGA graphic controller CL-GD542X manufactured by CIRRUS LOGIC is the chip adopted for the CRTC 22 of the embodiment. Besides the ordinary function as a CRTC, this single CRTC 22 chip has almost all the functions necessary for graphic control, such as an interface circuit for the computer, a graphic control function to process graphics, a memory control function to control the access to the memory, and a pallet DAC function for analog RGB signal. FIG. 3 is a block diagram showing an example of the internal configuration of the CRTC 22.

As shown in the Fig., the CRTC 22 is equipped with an CPU interface 60 to interface with signals to and from the computer 40 side, a CPU write buffer 62 to temporarily store the write data from the computer 40 side, a graphic controller 64 to plot a graphic with written data, a memory controller 66 to control the memory such as to write the image data generated by the graphic controller 64 onto the DRAM 24, a CRTC core 70 to read the information stored in the DRAM 24 via the memory controller 66 and to convert it into a video signal, a video FIFO 72 to consecutively store the graphic data which has been read for graphic displays from the DRAM 24 with the inclusion of a cursor display, an attribute controller 74 to control the attributes of the displayed image (reverse, underline, colors and so on), a pallet DAC 76 to convert digital data into analog RGB signal, and a dual clock generation circuit 78 to generate all the clocks required inside the CRTC 22 with the utilization of the source frequency from the oscillator 30.

The memory controller 66 performs such controls as the writing of graphic data generated by the graphic controller 64 onto the DRAM 24 and the reading of the data stored in the DRAM 24 at the correct timing for display. For this purpose, the memory controller 66 is equipped with a memory sequencer 67, a memory arbitrator 68 and a bit BLT 69. The timing of the data writing from the computer 40 side and that of the image plotting to accompany this are not synchronized with the timing of the graphic data reading for display by the CRTC core 70, a function for adjusting these timings is needed. The bit BLT 69 performs high-speed plotting of a rectangular image, contributing to an increase in the plotting speed, especially when plotting a number of windows.

Figure 4:
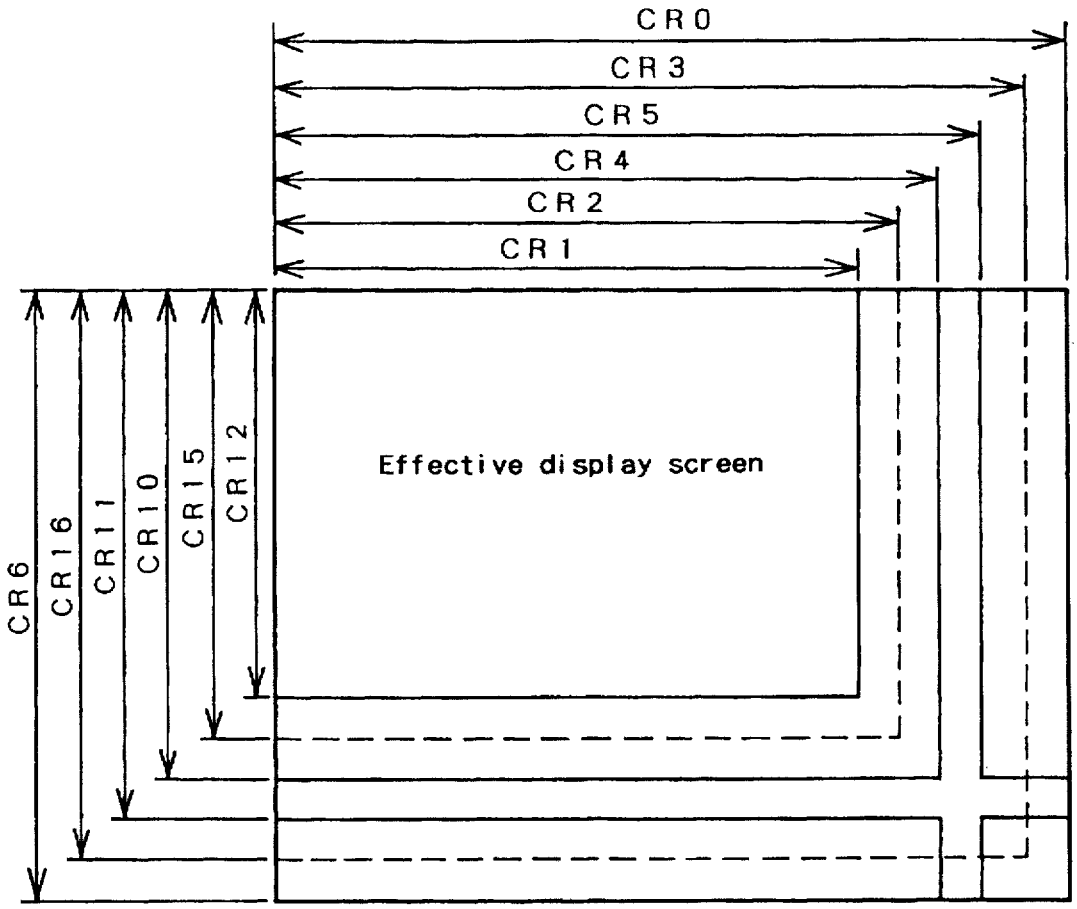
FIG. 4 is an illustrative drawing showing the relations between the internal registers of the CRTC 22 and the display.

The CRTC 22 is equipped with various types of registers for graphic display at the CRTC core 70. When the correct values are written onto these registers, a video signal matching the graphic display area of the CRT display device 50 can be output from the computer 40 side. FIG. 4 is an illustrative drawing showing the relations between the effective display screen and the registers on the CRTC 22 which realize this function.

The CRT display device 50 displays thirty images (frames) per second but it requires an additional reserved area (for some period of the operation time) outside of the effective display screen because horizontal retrace is required to carry out a horizontal scan by an electron gun and to return from the scan ending point to the next scan starting point and because, in the same way, vertical retrace is needed to carry out a vertical scan by an electron gun and to return from the scan ending point to the next scan starting point. The length of the effective display screen in the horizontal direction is preset at a register CR1 and the length of the effective display screen in the vertical direction is preset at a register CR12 respectively. The presetting operation is carried out based on the data of a maximum of 10 bits and the lower table on FIG. 4 shows how each bit is defined by what bit of which register. Those in the brackets show the bit locations inside the registers.

An approximate correspondence of the registers other than the registers CR1 and CR12 to the timing preset by each register is as follows:

Register CR2: Start timing of the horizontal blanking
Register CR4: Start timing of the horizontal retrace
Register CR5: End timing of the horizontal retrace
Register CR3: End timing of the horizontal blanking
Register CR0: Total timing of the horizontal direction
Register CR15: Start timing of the vertical blanking
Register CR10: Start timing of the vertical retrace
Register CR11: End timing of the vertical retrace
Register CR16: End timing of the vertical blanking
Register CR6: Total timing of the vertical direction Thus on the computer 40 side, an appropriate display is realized through writing the values matching the characteristics of the CRT display device 50 onto these registers. The horizontal retrace signal and the vertical retrace signal are output repetitively, and tFig.he intervals of these repetitions are 40.3 microseconds for the vertical retrace and 17.73 milliseconds for the vertical retrace if the signals are for the 640 dots by 400 lines CRT display 50 given in this embodiment. The frequencies of these repetitions are respectively called the horizontal synchronizing frequency and the vertical synchronizing frequency, and they are respectively 24.6 kHz and 56.4 Hz in this embodiment.

To carry out a display of 640 dots by 480 lines, on the other hand, the frequencies are respectively 36.5 microseconds (27.4 kHz) and 19.0 milliseconds (52.6 Hz). However, if a video signal of these synchronizing frequencies are transmitted from the beginning to the 640 dots by 400 lines CRT display 50, the CRT display device 50 will fail to synchronize and the screen image will become asynchronous. A normal display is not available because the synchronizing frequencies are out of the normal allowable range.

Figure 5:
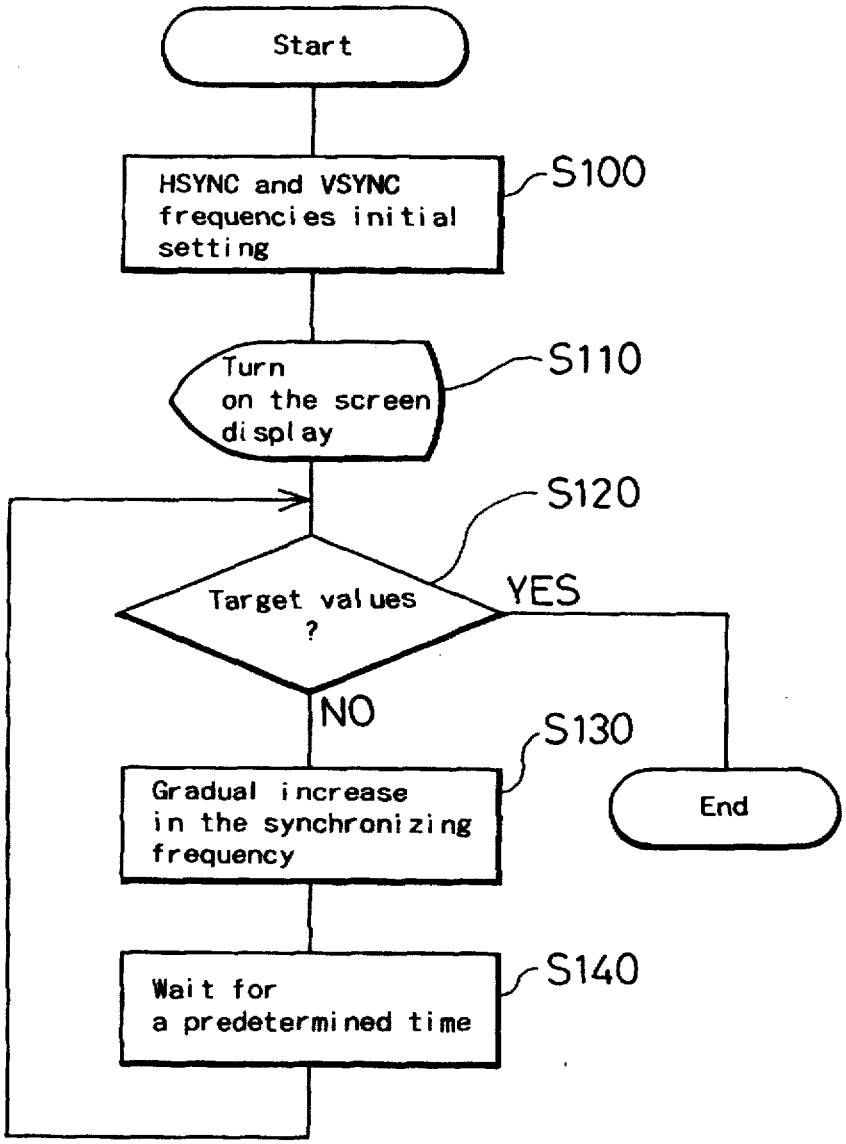
FIG. 5 is a flowchart showing the process carried out by the computer 40 to modify the number of lines displayed.

Therefore, the graphic board 20 of this embodiment carries out the display of 640 dots by 480 lines the 640 dots by 400 lines CRT display 50 through carrying out such processes on the computer 40 side as shown in FIG. 5. A device driver for the graphic display is installed in the computer 40 if the system is started up by a certain operating system, and the synchronizing frequency increment process routine as shown in FIG. 5 is carried out at the start up of the operating system.

When this routine is started up, a value corresponding to the frequency (24.8 kHz) which corresponds to the 640 dots as for the horizontal synchronizing frequency and a value corresponding to 47.8 Hz as for the vertical synchronizing frequency are respectively preset first as initial values at the registers on the graphic board 20 (step S100). For the reason described below, the frequency (56.4 Hz) which corresponds to 400 lines is not preset here as for the vertical synchronizing frequency. In this embodiment, the adjustment of the frequencies is made only on the horizontal synchronizing frequency. Since the desired final number of lines is 520, inclusive of the number of surplus lines (40 lines) which are not to be displayed, the repetition time Tv in the vertical direction calculated from the horizontal synchronizing frequency 24.8 kHz is:

$$Tv = (1/24.8K) \times 520 = 20.9 \text{ milliseconds}$$

Therefore, the frequency fv is:

$$fv = 1/Tv = 47.8 \text{ Hz}$$

At the next step, the screen display is turned on (step Sl10) and display is started. Since the horizontal synchronizing frequency is an adequate value for the CRT display device 50 at this point, the CRT display device 50 is synchronous in the horizontal direction. As for the vertical direction, it is not synchronous and the screen does not show a perfectly normal image.

At the next step, a judgement is made on whether the horizontal and the vertical synchronizing frequencies are target values or not (step S120). The target values here of the horizontal and the vertical synchronizing frequencies (27.4 kHz and 52.6 Hz) are those which correspond to 640 dots by 480 lines. Of course, the target values have not been realized at this time, immediately after start-up, the judgement at step S120 is "NO" and the sequence goes to step S130 where the gradual increase of a horizontal synchronizing frequency is carried out. Each increment of the synchronizing frequency is 1.0 percent or so. Next, the computer 40 carries out the process of standby for a predetermined period of time through repetition of the process where nothing is carried out for a predetermined number of times (step S140). The standby time in this embodiment is approximately 14 milliseconds.

Now the sequence returns to step S120 and the judgement on whether the synchronizing frequency has reached the target value is carried out again. Through repetition of steps S120 through S140, the horizontal and the vertical synchronizing frequency eventually reach the target values and the judgement at step S120 is given as "YES" to conclude the processes in this routine. Here the horizontal synchronizing frequency is 27.4 kHz, and thus the repetition time Tv in the vertical direction is:

$$Tv = (1/27.4K) \times 520 = 18.97 \text{ milliseconds}$$

And thus the frequency fv is:

$$fv = 1/Tv = 52.6 \text{ Hz}$$

When the above-described processing routine is carried out, the frequencies of the horizontal and the vertical synchronizing signals of the video signal output from the graphic board 20 to the CRT display device 50 gradually change from the values where the horizontal synchronizing signal corresponds to the display of 640 dots by 400 lines to the values corresponding to the display of 640 dots by 480 lines. Once the synchronization is established properly in the horizontal direction, the CRT display device 50 continues to display the images correctly in a wide range to some extent since an internal synchronization circuit works against fluctuation of the synchronizing signals later. That is, if a video signal of which the frequency is largely deviated from the normal value is output from the beginning, the CRT display device 50 cannot synchronize. However, if the frequency is gradually increased after synchronization with a normal value in the horizontal direction, normal display is obtainable even with a 20 percent increase in the number of lines.

Therefore, a display environment of such a higher resolution as a 20 percent increase in the vertical direction, 640 dots by 480 lines, can be realized without any additional hardware except the graphic board 20. To change the 640 dots by 400 lines environment into a 640 dots by 480 lines environment in a conventional way, the CRT display device 50 also has to be replaced or an expensive multisynchronization-type CRT display device has to be included in the system. On the other hand, with the use of the graphic board 20, there is no need for change in the hardware related to the CRT display device 50, and the user can try an environment of a higher resolution immediately if only the graphic board 20 is included in the system.

The paragraphs above have described the embodiment of the present invention; however, the invention is not confined to such an embodiment but to other embodiments in various modes that are also possible without departing from the scope of this invention. For example, another embodiment may have a structure where the initial values of the synchronizing frequencies in the horizontal and the vertical directions are preset as those corresponding to the 640 dots by 400 lines, and both the horizontal synchronizing frequency and the vertical synchronizing frequency may be modified gradually afterwards. Another embodiment may have a structure where the initial values of the horizontal and the vertical synchronizing frequencies are preset a little higher than the theoretical values so as to meet the characteristics of the CRT display device in use. The invention may be applied to a graphic display device for a CRT display device of a higher resolution than 640 dots by 400 lines. The number of the dots in the horizontal direction may be increased without any trouble. Still other preferred embodiments may have a structure where the gradual increase in the horizontal and the vertical synchronizing frequencies is realized not by the software of the computer 40 but by software or hardware on the graphic board 20 or a structure where the graphic display device is assembled as an integral part of the computer.

I claim:

1. A graphic display controller device for increasing the apparent resolution of an external display device having a designated resolution having a designated number of lines and a designated number of pixels per line associated therewith, the graphic display controller device being arranged to output a video signal containing display information for a number of pixels, a horizontal synchronizing signal and a vertical synchronizing signal to the external display device wherein the number of pixels of display information in the video signal is larger than a number of designated pixels in said external display device, said graphics display controller device comprising:

an initial frequency presetting means for presetting a frequency of one of said horizontal synchronizing signal and said vertical synchronizing signal to a initial value which corresponds to the designated number of lines or the designated number of pixels per line wherein the initial frequency presetting means synchronizes said external display device in at initial display state; and a preset frequency modification means for gradually modifying said preset frequency to a target value corresponding to a number of lines or pixels per line which is larger than the designated number of lines or the designated number of pixels per line associated with said external display device.

2. A graphic display controller device claimed in claim 1 further comprising registers for setting said horizontal synchronizing signal and said vertical synchronizing signal, and wherein said initial frequency presetting means and said preset frequency modification means are arranged to set values in said registers.

3. A graphic display controller device claimed in claim 1 further comprising a switching means for switching between a first video signal input from an external device and that corresponds to said designated resolution and a second video signal which has been adjusted to said target value such that the number of pixels of display information in the video signal is larger than a number of designated pixels in said display device preset by said initial frequency presetting means and said preset frequency modification means outputted to said display device.

4. A graphic display controller device claimed in claim 1 which further comprises two connectors having distinct pin arrays each connector being arranged to transmit output of said video signal at an associated resolution to said display device.

5. A graphic display controller device claimed in claim 1 wherein the graphic display controller is mounted on an expansion board suitable for insertion into an expansion slot of a computer, and the resolution of the display device may be increased by said preset frequency modification means causing said computer to gradually change target values of said horizontal synchronizing signal and said vertical synchronizing signal.

6. A computer having a graphic display controller device for outputting a video signal comprising a horizontal synchronizing signal and a vertical synchronizing signal for displaying an image on an external display device wherein the number of pixels of display information in the video signal is larger than a number of designated pixels in said external display device, the graphic display controller device is mounted on an expansion board suitable for insertion into an expansion slot accessible by a processor, wherein said graphics display device comprises;

an initial frequency presetting means for presetting a frequency of one of said horizontal synchronizing signal and said vertical synchronizing signal to a initial value which corresponds to the designated number of lines or the designated number of pixels per line wherein the initial frequency presetting means synchronizes said external display device in an initial display state; and a preset frequency modification means for gradually modifying said preset frequency to a value corresponding to a number of lines or pixels per line which is larger than the designated number of lines or the designated number of pixels per line associated with said external display device.

7. A method of controlling a graphic display assembly wherein a video signal containing a horizontal synchronizing signal and a vertical synchronizing signal is outputted to display a image on the display assembly such that the resolution of the display assembly is increased relative to a designated display resolution by increasing at least one of the number of display lines and the number of pixels per line, said method comprising the steps of:

presetting a frequency of a selected one of said horizontal synchronizing signal and said vertical synchronizing signal to create a initial value which corresponds to an associated numbers of pixels per line or number of display lines to which said display assembly can synchronize in a initial stage of display;

after synchronization to said initial value, gradually modifying the selected one of the horizontal synchronizing signal and the vertical synchronizing signal to a target value corresponding to a modified resolution that is increased relative to the designated display resolution; and displaying an image on the display assembly at the modified resolution.

8. A method as claimed in claim 7, wherein a gradual modification of the target value is performed by a device driver which is included in a operating system of a computer and is carded out as part of a initial processing operation of said device driver at the time of starting up said operating system.

9. A graphic display controller device as recited in claim 1 wherein the external display device is a cathode ray tube based display.

* * * * *

UNITED STATES PATENT AND TRADEMARK OFFICE

CERTIFICATE OF CORRECTION

PATENT NO. : 5,736,971
DATED : April 7, 1998
INVENTOR(S) : Shirai

It is certified that error appears in the above-identified patent and that said Letters Patent is hereby corrected as shown below:

Title page,
Change the PCT Filed date from "April 4, 1994" to -- April 27, 1994 --.

Signed and Sealed this

Eleventh Day of June, 2002

*Attest:*

*Attesting Officer*

JAMES E. ROGAN
*Director of the United States Patent and Trademark Office*